US007931040B2

(12) United States Patent
Holacka et al.

(10) Patent No.: US 7,931,040 B2
(45) Date of Patent: Apr. 26, 2011

(54) PORTABLE SHELTER

(75) Inventors: John Christopher Holacka, Wylie, TX (US); Scott Alan Stout, Sachse, TX (US)

(73) Assignees: John C. Holacka; Nortex Industrial Fan Co., Garland, TX (US)

( * ) Notice: Subject to any disclaimer, the term of this patent is extended or adjusted under 35 U.S.C. 154(b) by 71 days.

(21) Appl. No.: 12/454,080

(22) Filed: May 12, 2009

(65) Prior Publication Data

US 2009/0277487 A1 Nov. 12, 2009

(51) Int. Cl.
*E04H 15/48* (2006.01)

(52) U.S. Cl. ..... 135/154; 135/117

(58) Field of Classification Search ..... 135/19, 135/156, 154, 153, 144, 146, 118, 117; 160/76, 160/77, 72, 73, 81, 50
See application file for complete search history.

(56) References Cited

U.S. PATENT DOCUMENTS

| | | | | | |
|---|---|---|---|---|---|
| 1,245,944 | A * | 11/1917 | Morgan | 135/98 |
| 1,407,040 | A * | 2/1922 | Myers | 135/153 |
| 1,493,915 | A * | 5/1924 | Baker | 135/146 |
| 2,771,125 | A | 11/1956 | Dobbins | |
| 2,970,600 | A * | 2/1961 | Schultz | 135/140 |
| 3,052,251 | A * | 9/1962 | Jean, Jr. | 135/96 |
| 3,434,483 | A * | 3/1969 | Topham | 135/151 |
| 5,088,514 | A * | 2/1992 | House et al. | 135/139 |
| 5,135,281 | A | 8/1992 | Pappalardo | |
| 5,277,214 | A * | 1/1994 | Tolley | 135/133 |
| 5,513,670 | A | 5/1996 | Childress et al. | |
| 5,531,239 | A * | 7/1996 | Hannah, Jr. | 135/88.1 |
| 5,791,363 | A * | 8/1998 | Moses | 135/143 |
| 6,244,286 | B1 * | 6/2001 | Russo | 135/128 |
| 6,789,557 | B1 | 9/2004 | Wahl, Jr. | |
| 7,347,217 | B2 * | 3/2008 | Bree et al. | 135/149 |
| 7,585,020 | B1 * | 9/2009 | Wahl, Jr. | 297/184.15 |
| 2002/0112752 | A1 | 8/2002 | Blakney | |

* cited by examiner

*Primary Examiner* — David Dunn
*Assistant Examiner* — Noah Chandler Hawk
(74) *Attorney, Agent, or Firm* — Carmen Patti Law Group, LLC

(57) ABSTRACT

An apparatus in one example is a portable shelter to be set up on a ground surface, the shelter having: first and second arms; a sheet connected at a first edge thereof to the first arm, and at a second, opposite edge thereof to the second arm; first and second legs intended for generally vertical alignment when the shelter is open, so that each leg has a top end and bottom end, the legs having a rotational connection at the top ends thereof to ends of the first and second arms, respectively; means attached to the bottom end of each leg for mounting the legs on the ground surface; whereby the arms and sheet may be rotated to an open position apart from the legs, to provide shelter, and may be rotated to a closed position along the legs.

7 Claims, 3 Drawing Sheets

PORTABLE SHELTER

TECHNICAL FIELD

The invention relates generally to a portable shelter, and in particular to a portable shelter that protects a user from elements, such as, wind and the sun.

BACKGROUND

Over the years, various sunshade devices have been developed for providing shade to sunbathers or the like. Conventional umbrella-type devices are still widely used by beachgoers, homeowners, and commercial establishments such as restaurants, hotels and resorts, as a means to provide shade to the user against the sun's rays. However, such devices do not provide shelter from other elements, such as, wind.

Others have devised sunshades, which are designed to attach to beach chairs. However, the reality is that most people do not bring chairs or lounges to the beach: they enjoy lying on the sand.

Another prior art shade is a ground-supported shade having an adjustable canopy. A further example is a portable, free-standing shelter for hunters and the like that is of generally frusto-conical configuration and has a base and upwardly inclined sidewalls terminating in an open top. The sidewalls are defined by a plurality of panels of generally triangular or trapezoidal configuration, having top and bottom edges connected by upwardly convergent opposite sides. Hinged connecting means interconnect adjacent sides of the panels in articulated relation so that the bottom edges of the panels define the base of the shelter and the top edges of the panels define the open top thereof. The connected panels may then be arranged into various configurations, including a substantially open shelter or screen, or a closed or partially closed shelter as desired.

SUMMARY

One embodiment according to the present apparatus may comprise a portable shelter to be set up on a ground surface. The shelter may have: first and second arms; a sheet connected at a first edge thereof to the first arm, and at a second, opposite edge thereof to the second arm; first and second legs intended for generally vertical alignment when the shelter is open, so that each leg has a top end and bottom end, the legs having a rotational connection at the top ends thereof to ends of the first and second arms, respectively; means attached to the bottom end of each leg for mounting the legs on the ground surface; whereby the arms and sheet may be rotated to an open position apart from the legs, to provide shelter, and may be rotated to a closed position along the legs.

Another embodiment according to the present apparatus is a shelter that may have a frame having an open position and a closed position. The frame may have: at least first and second legs; at least first and second arms; at least first and second joints structured to pivotally connect the first and second legs to the first and second arms, respectively; positioning means for spacing the first leg and the first arm apart from the second leg and the second arm for the open position, and for positioning together the first leg and the first arm with the second leg and the second arm for the closed position. The apparatus may also have at least one means for sheltering operatively coupled between the at least first and second legs, and between the at least first and second arms.

DESCRIPTION OF THE DRAWINGS

The features of the embodiments of the present method and apparatus are set forth with particularity in the appended claims. These embodiments may best be understood by reference to the following description taken in conjunction with the accompanying drawings, in the several figures of which like reference numerals identify like elements, and in which:

DETAILED DESCRIPTION

Figure 1:
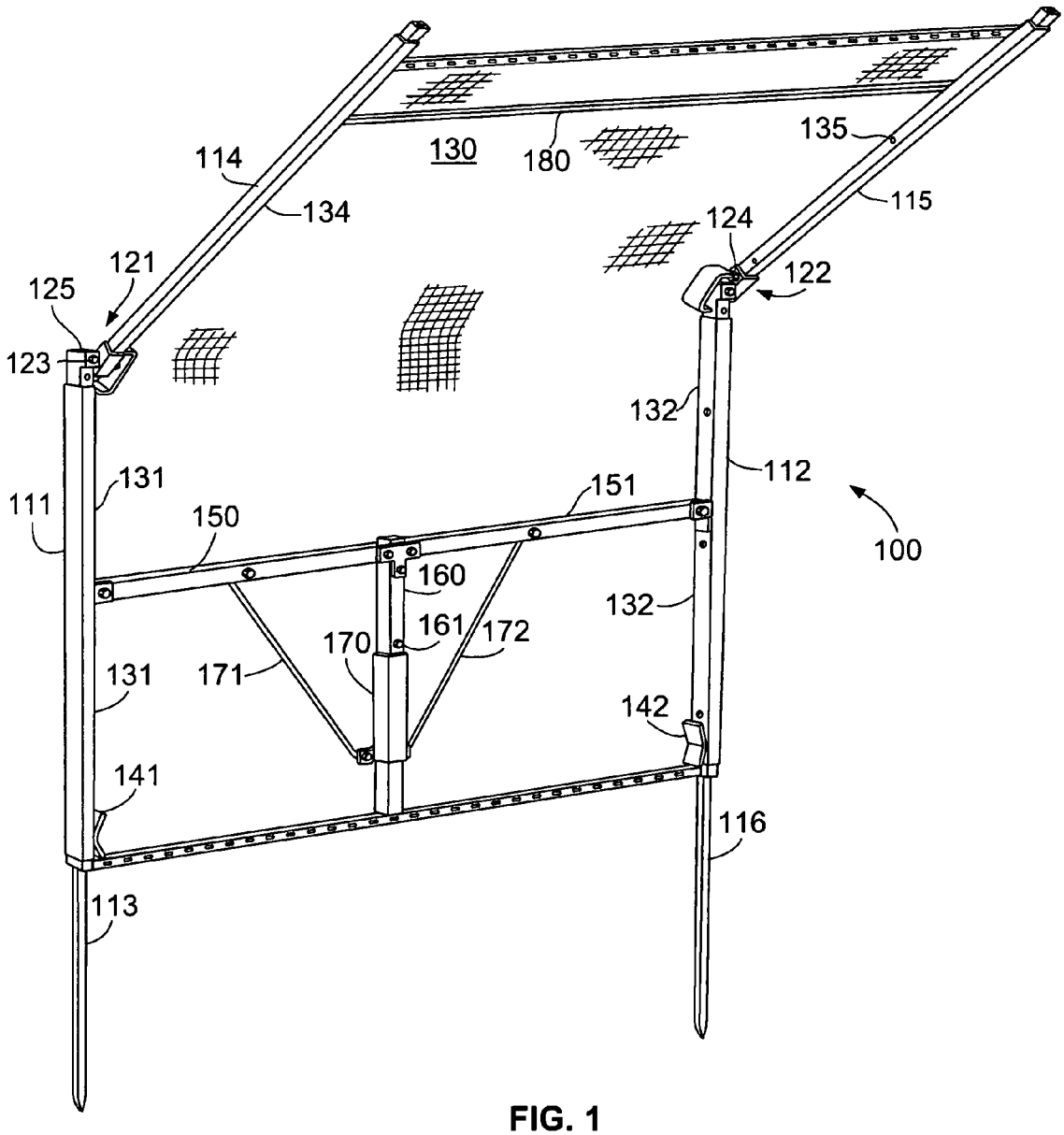
FIG. 1 depicts, in an embodiment according to the present method and apparatus, a shelter in an open position.

FIG. 1 shows a shelter 100 in accordance with our invention, in an open position. Structural elements of shelter 100 include legs 111 and 112, which are intended to stand in a roughly vertical position. In addition, there are arms 114 and 115, pivotally mounted to legs 111 and 112, respectively, at joints 121 and 122. A sheet 130 is mounted along one edge 131 to leg 111, along another, opposite edge 132 to leg 112, along an edge 134 to arm 114, and along another edge 135, opposite edge 134, to arm 115. In a preferred embodiment, sheet 130 is comprised of sunscreen material such as Sunscreen or Super Solar Screening manufactured by Phifer Incorporated.

Arm 114 can rotate toward (and away from) leg 111, so that in a closed arrangement or position of the shelter, arm 114 lies along leg 111, that is, against leg 111 and parallel to it. FIG. 1 illustrates the rotation as being about a shaft of a bolt 123, which connects arm 114 to a pair of tabs 125 fixed to leg 111. Arm 115 can rotate about the shaft of a bolt 124 in the same manner with respect to leg 112. For convenience, connectors herein are described as bolts, but it will be understood by those skilled in the art that other connectors such as rivets can be used to perform the attachments and provide shafts for the rotations described.

Shelter 100 can be mounted on the ground surface by stakes 113 and 116, each tapered as shown. Stake 113 is fitted in a collar (not shown) within leg 111, so that the stake can slide in and out of leg 111. In a closed position, the stake 113 is contained within leg 111. The extension of stake 113 with respect to leg 111 is maintained by a clamp 141, illustrated further in FIG. 3. In the same manner, a stake 116 is fitted to slide with respect to leg 112 and clamped in place by a clamp 142.

In an alternative embodiment, the shelter can have feet to be attached to each leg, so as to support and mount the shelter on a hard ground surface such as concrete. In yet another alternate embodiment, the legs 111 and 112 can have clamps for attaching the shelter to bleachers and the like. In still a further embodiment, the legs can have magnetic material for attachment to metal surfaces, for example to an air conditioner, to shade it.

In the open position illustrated in FIG. 1, the sheet 130 as a sun screen shades or screens the area in its shadow. The position of sheet 130 can be adjusted by rotating arms 114 and 115 up or down. The positions of arms 114 and 115 are held in place with respect to legs 111 and 112 respectively by friction applied at joints 121 and 122 by tightening of bolts 123 and 124.

Figure 2:
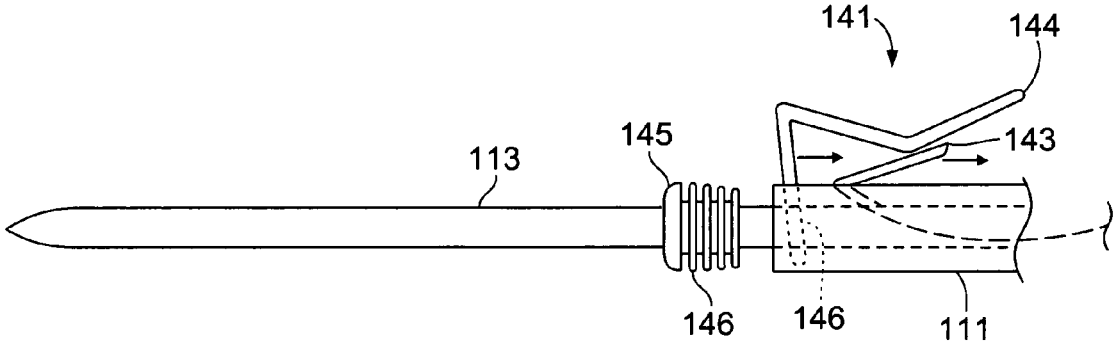
FIG. 2 depicts a clamp in greater detail for use in the present method and apparatus.

FIG. 2 illustrates clamp 141 in greater detail. A lever 144 is held against a spring 143 that is mounted in leg 111 and compressed against the wall of leg 111. The lever 144 is held against spring 143 by a grommet 145, which is shown in the drawing in a disassembled position. When the clamp 141 is assembled, grommet 145 is held in the end of leg 111 by ribs 146 on the grommet. Stake 113 is mounted through a hole in the end 146 of lever 144. The stake is held stationary, because the top and bottom edges of the hole in the end of lever 144 bind against the stake 113. The spring 143 pushes on lever 144 so as to hold these edges against the stake. In order to move the stake 113 in and out of the leg 111, one depresses lever 144 against the spring 143 and toward leg 111. As the lever is depressed, end 146 moves toward a position, which is nearly perpendicular to the stake 113. As it moves toward this position, the top and bottom edges of the hole cease to bind against the stake and free it to move to a new position.

Figure 3:
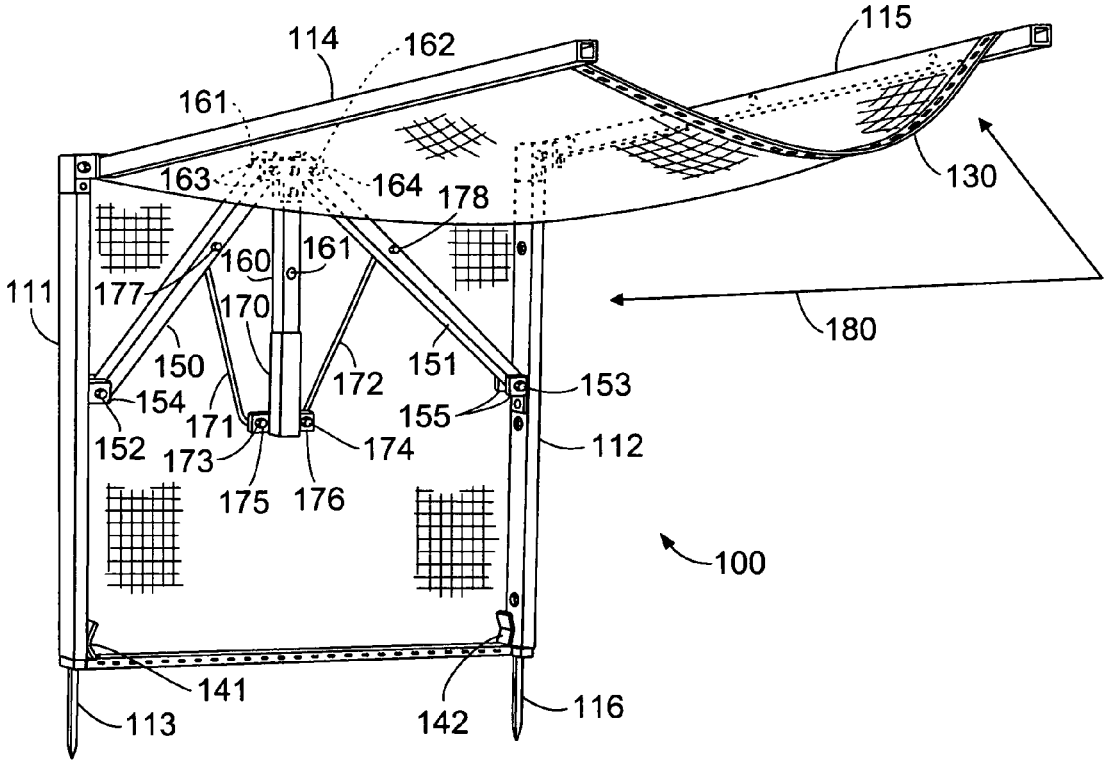
FIG. 3 depicts structural elements of the shelter in transition between an open and a closed position.

FIG. 3 shows structural elements of the shelter 100 in transition between an open and a closed position. A brace 151 rotates about the shaft of bolt 153 connecting brace 151 to a pair of tabs 155 fixed to leg 112. In the same manner, brace 150 rotates about the shaft of a bolt 154 connecting brace 150 to a pair of tabs 154 fixed to leg 111. At its other end, brace 150 rotates about the shaft of a bolt 161, connecting the brace to a pair of tabs 163 fixed to a central member 160. In the same manner, brace 151 rotates about the shaft of a bolt 162, connecting the brace to a pair of tabs 164 fixed to central member 160.

A collar 170 is fitted to slide along central member 160 until it hits a stop 161 fixed on central member 160. A link 172 is connected to rotate about the shaft of a bolt 174 connecting link 172 to a tab 176 fixed to collar 170. At the other end of link 172, it is connected to rotate about the shaft of a bolt 178 mounted in brace 151. Likewise, a link 171 is connected to rotate about the shaft of a bolt 173 connecting link 171 to a tab 175 fixed to collar 170. At the other end of link 171, it is connected to rotate about the shaft of a bolt 177 mounted in brace 150. A rod 180 may have its ends inserted into opposing holes or other holders in or on arms 114 and 115 to control the distance between the arms.

Further in FIG. 3, central member 160 is shown in a raised position with respect to legs 111 and 112. In this position, collar 170 is on a lower portion of central member 160. By comparison, in FIG. 1, collar 170 has moved up on central member 160 to rest against stop 161. The positioning of the central member 160 in FIG. 1 causes braces 150 and 151 to be in a bracing alignment approximately perpendicular to legs 111 and 112. The braces 150 and 151 are prevented from moving above this alignment by the links 171 and 172 connected to collar 170, which is held by stop 161.

Figure 4:
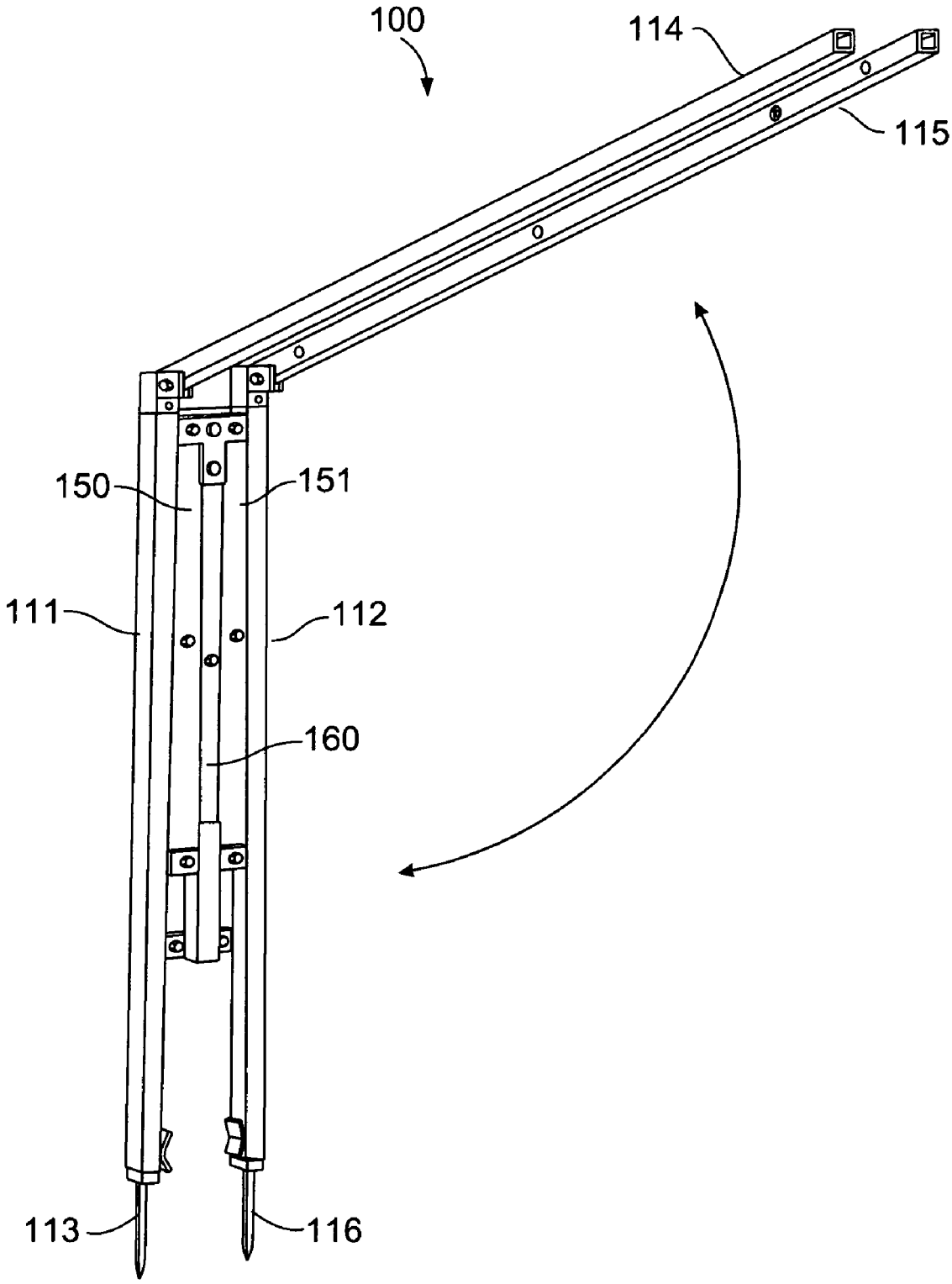
FIG. 4 depicts the shelter in a nearly closed position.

FIG. 4 shows the shelter 100 in a nearly closed position. From the position of FIG. 3, legs 111 and 112 have been pulled toward each other until leg 111 is beside brace 150, which is beside central member 160, which is beside brace 151, which is beside leg 112. To complete closure, arms 114 and 115 are rotated down until they lie along legs 111 and 112, respectively. Stakes 113 and 116 are shown extending somewhat from legs 111 and 112, but they may be slid into the legs so as to be contained by them. When the shelter 100 is completely closed, it forms a long, narrow bundle, which is compact for storage and carrying.

It can be appreciated from the description above that the shelter of the invention provides the intended sheltering when opened, but can be closed into a compact form convenient to carry and stow in a vehicle. In addition, the shelter maintains its open sheltering position well in the presence of wind, so that it is useful in a range of circumstances.

The steps or operations described herein are just exemplary. There may be many variations to these steps or operations without departing from the spirit of the invention. For instance, the steps may be performed in a differing order, or steps may be added, deleted, or modified.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following. For example, the shelter may also be a permanently fixed shelter.

What is claimed is:

1. A shelter apparatus capable of conveniently being opened and closed, comprising:

a frame having a frame open position and a frame closed position;

the frame having:

first and second legs, said legs having a legs open position with respect to each other, being the position of the legs with respect to each other when the frame is in the frame open position;

first and second arms;

first and second joints structured to pivotally connect the first and second legs to the first and second arms, respectively;

each leg having a first end operatively coupled to the first joint, and having a second end;

a support means for operatively coupling a respective leg with a ground surface, the support means operatively coupled to the second end of the respective leg;

positioning means for spacing the first leg and the first arm apart from the second leg and the second arm for the frame open position, and for positioning together the first leg and the first arm with the second leg and the second arm for the frame closed position, including means, responsive to the legs reaching the legs open position upon being pulled apart from each other, for holding the legs with respect to each other in the legs open position corresponding to the frame open position, thereby avoiding further steps to hold the legs in said legs open position and facilitating opening of the shelter, said means for holding including a first brace having a first end rotateably connected to a location on the first leg between the first and second ends thereof;

a second brace having a first end rotateably connected to a location on the second leg between the first and second ends thereof;

a central member having a first end rotateably connected to a second end of the first brace and to a second end of the second brace;

a collar fitted to slide along the central member;

a stop fixed on the central member between the collar and the first end of the central member, said collar sliding until it hits the stop;

a first link having a first end rotateably connected to a predetermined location on the first brace, and having a second end rotateably connected to the collar; and a second link having a first end rotateably connected to a predetermined location on the second brace, and having a second end rotateably connected to the collar, said braces, central member, links, collar, and stop being arranged so that the collar sliding toward the first end of the central member causes the braces to extend outwards from the central member until the collar hits the stop, and arranged so that when the collar is against the stop, the braces are aligned with respect to the legs to hold the legs in said legs open position; and means for sheltering operatively coupled between the at least first and second legs, and between the at least first and second arms.

2. The apparatus according to claim 1, wherein the means for sheltering is a flexible sheet.

3. The apparatus according to claim 1, wherein the first and second legs are in an approximately vertical position in the open position of the frame.

4. The apparatus according to claim 1, wherein the support means is a stake that is extendable from the second end of the respective leg when the frame is in the open position, and that is retractable into the second end of the respective leg when the frame is in the closed position.

5. The apparatus according to claim 1, wherein the apparatus comprises a rod having first and second ends releaseably coupled to the ends of the first and second arms.

6. The apparatus according to claim 1, wherein the means for sheltering is operatively coupled along one edge of the first leg, along an opposed edge of the second leg, along one edge of the first arm, and along an opposed edge of the second arm.

7. The apparatus according to claim 1, wherein the means for sheltering is at least one of a material that at least partially blocks sunlight and a material that at least partially blocks wind.

* * * * *